US006612428B1

(12) United States Patent
Segovia, Jr. et al.

(10) Patent No.: US 6,612,428 B1
(45) Date of Patent: Sep. 2, 2003

(54) DISPOSABLE/RECYCLABLE BEVERAGE DEVICE

(76) Inventors: Eugenio Segovia, Jr., 205 Heritage Trail North, Bellville, TX (US) 77418; Kurt S. Myers, 7634 Braesdale, Houston, TX (US) 77071

( * ) Notice: Subject to any disclaimer, the term of this patent is extended or adjusted under 35 U.S.C. 154(b) by 0 days.

(21) Appl. No.: 09/757,756

(22) Filed: Jan. 10, 2001

Related U.S. Application Data

(60) Provisional application No. 60/212,860, filed on Jun. 20, 2000.

(51) Int. Cl.[7] ..... B65D 25/08

(52) U.S. Cl. ..... 206/219; 206/222; 215/11.3

(58) Field of Search ..... 206/219, 222; 215/11.1, 11.3

(56) References Cited

U.S. PATENT DOCUMENTS 2,885,104 A 5/1959 Greenspan
4,664,288 A * 5/1987 Pereira et al. ..... 215/207
4,678,092 A * 7/1987 Rane ..... 215/11.1
4,700,856 A * 10/1987 Campbell et al. ..... 215/11.1
4,821,913 A * 4/1989 Hidding ..... 220/270
5,000,314 A * 3/1991 Fuller et al. ..... 206/219
5,476,322 A * 12/1995 Stoody ..... 248/99
5,758,787 A * 6/1998 Sheu ..... 215/11.1
5,996,833 A * 12/1999 Lencioni et al. ..... 215/251
6,089,389 A * 7/2000 Sharon et al. ..... 141/9

FOREIGN PATENT DOCUMENTS

WO 0 265 048 * 4/1988

* cited by examiner

*Primary Examiner*—David T. Fidei
(74) *Attorney, Agent, or Firm*—Kurt S. Myers

(57) ABSTRACT

The present invention is directed to a dispenser having a plastic bag with two compartments, one containing liquid and the other solid, and a connector having a neck member that holds the bag. The bag has a sealed seam which is easily rupturable separating said compartments. The connector may have a variety of caps for dispensing the mixed liquid and solid. More specifically, the present invention is directed to a disposable/recyclable baby bottle. The bag in this embodiment holds water in one compartment and baby formula in a second compartment.

11 Claims, 5 Drawing Sheets

DISPOSABLE/RECYCLABLE BEVERAGE DEVICE

RELATED APPLICATIONS

This application is based on provisional application Ser. No. 60/212,860, filed Jun. 20, 2000, entitled "Disposable Baby Bottle", which is incorporated herein by reference.

FIELD OF THE INVENTION

The present invention relates to a disposable beverage device having a plastic bag with two compartments, one containing liquid and the other solid, and a connector having a neck member that holds the bag. More specifically, the present invention is directed to a disposable/recyclable baby bottle. The bag in this embodiment holds water in one compartment and baby formula in a second compartment.

BACKGROUND OF THE INVENTION

In places where water is safe, clean and available, infant formula is purchased in bulk and mixed with water. However, in places where water is unsafe and contaminated, using bulk solids, such as baby formula or other beverages, mixing the bulk solids with contaminated water has led to serious medical problems and often death. Further the mixing of formula for infants in bulk with available water may be simply inconvenient when at a campsite or on a trip, whether it be by automobile, train or plane. It is the object of the present invention to provide a beverage dispenser that maintains the bulk solid separate from the liquid until ready for use and to assure that a safe product is available to the user.

U.S. Pat. No. 2,885,104 discloses a bottle with a disposable cartridge. The cartridge has two compartments, one containing a powder and the other liquid. These compartments are separated by a sealing juncture that is penetrated by pulling a tab. When pulled, the tab breaks the sealing juncture, allowing the liquid to mix with the powder for dispensing.

SUMMARY OF THE INVENTION

The present invention is directed to a dispenser having a plastic bag with two compartments, one containing liquid and the other solid, and a connector having a neck member that holds the bag. The bag has a sealed seam which is easily rupturable separating the compartments. The connector may have a variety of caps for dispensing the mixed liquid and solid. More specifically, the present invention is directed to a disposable/recyclable baby bottle. The bag in this embodiment holds water in one compartment and baby formula in a second compartment.

DESCRIPTION OF THE PREFERRED EMBODIMENTS

The present invention is directed to a dispenser that includes a connector and a plastic bag that has two compartments, one for holding solid and one for holding liquid. A sealed seam which is easily rupturable separates the compartments. The solid may be selected from many beverage concentrates such as infant formula or fruit drinks and the liquid is preferably water. The dispenser preferably has a seal at the top, a plastic sheet with a tab.

Figure 2:
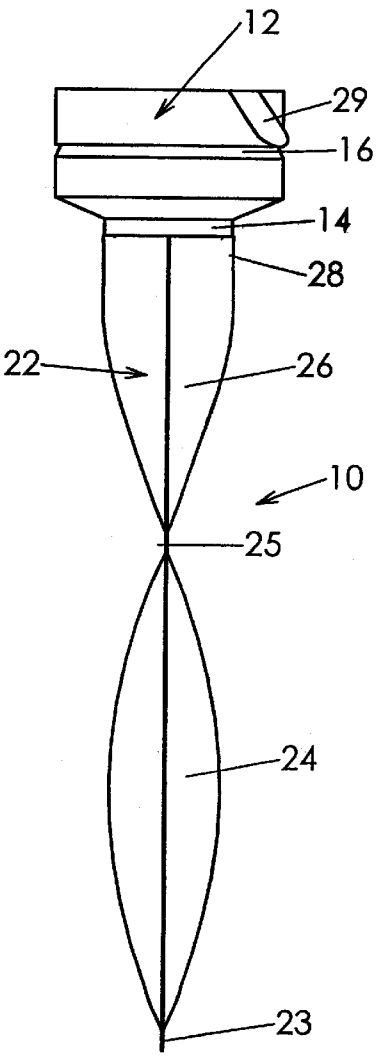
FIG. 2 is a side view of the connector and bag of the present invention showing the seal between compartments and the tab of the seal to the top of the connector.
Figure 1:
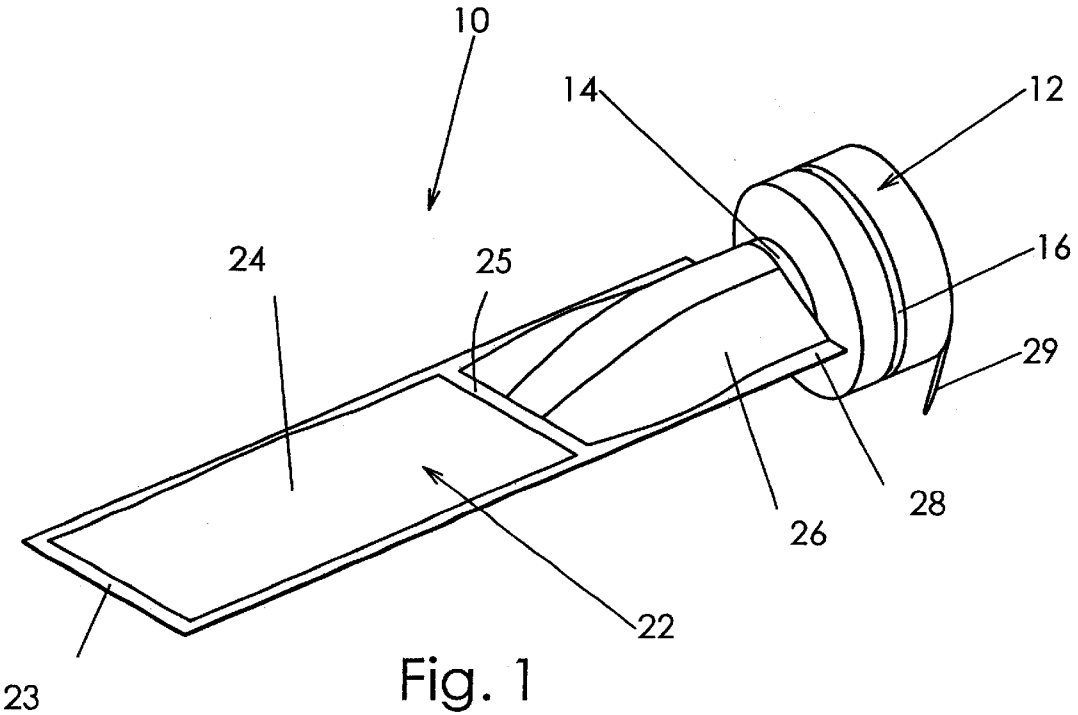
FIG. 1 is an isometric view of the connector and bag of the present invention.

Referring to FIG. 1 and 2, a dispenser 10 of the present invention includes a connector 12 and a plastic bag 22 having two compartments 24 and 26. The connector 12 is a solid cylinder having a top and a bottom and the bottom being solid except having a neck shaped internally open member 14 extending there from. The connector 12 together with neck member 14 is preferably injection molded from a plastic such as polyethylene or polypropylene as a single solid piece. Other injection molding plastics may be used. On the outside circumference of connector 12 is a groove 16. This feature of a circumferential groove 16 is important since a variety of caps, which will be disclosed in more detail hereinafter, may be attached to the dispenser 10. The neck member 14 is internally open as well as the top of the connector 12. The bag 22 is preferably made from a polyolefin film such as polyethylene. The bag 22 has two compartments 24 and 26 which are made in the filling operation. How the bag 22 is formed and filled is not a part of the present invention but depends on the equipment used in those operations. According to the present invention, one compartment is filled with a solid and the other compartment with a liquid. Preferably the solid is an infant formula or a beverage concentrate such as apple, fruit punch, orange, grape and other juice flavors suitable for infants. While the emphasis has been placed on infants, it is understood that the present invention has application for all ages and the beverages may be for sick and/or healthy youth and adults. The bag 22 is sealed at the bottom 23. A seal 25 is between compartments 24 and 26 which is made of a sufficient size to keep the solid and liquid separate during packaging and distribution but is easily broken when the solid and liquid in the compartments are desired to be mixed. The top of the bag 22 is sealed creating a seal 28 that closes and seals the top the bag 22 to the neck member 14 of connector 12. After filling bag 22 with a solid and liquid and sealing the bag 22 to the connector 12, a plastic cover (a sheet of plastic or foil) with a tab 29 is applied to close the top of connector 12 and completes a dispenser 10 of the present invention. It is clear that in the filling operation that the solid may be in compartment 24 and the liquid in compartment 26 or vice versa. In any event, filled dispensers 10 may be filled and shipped in quantity rather than as single units.

Figure 3:
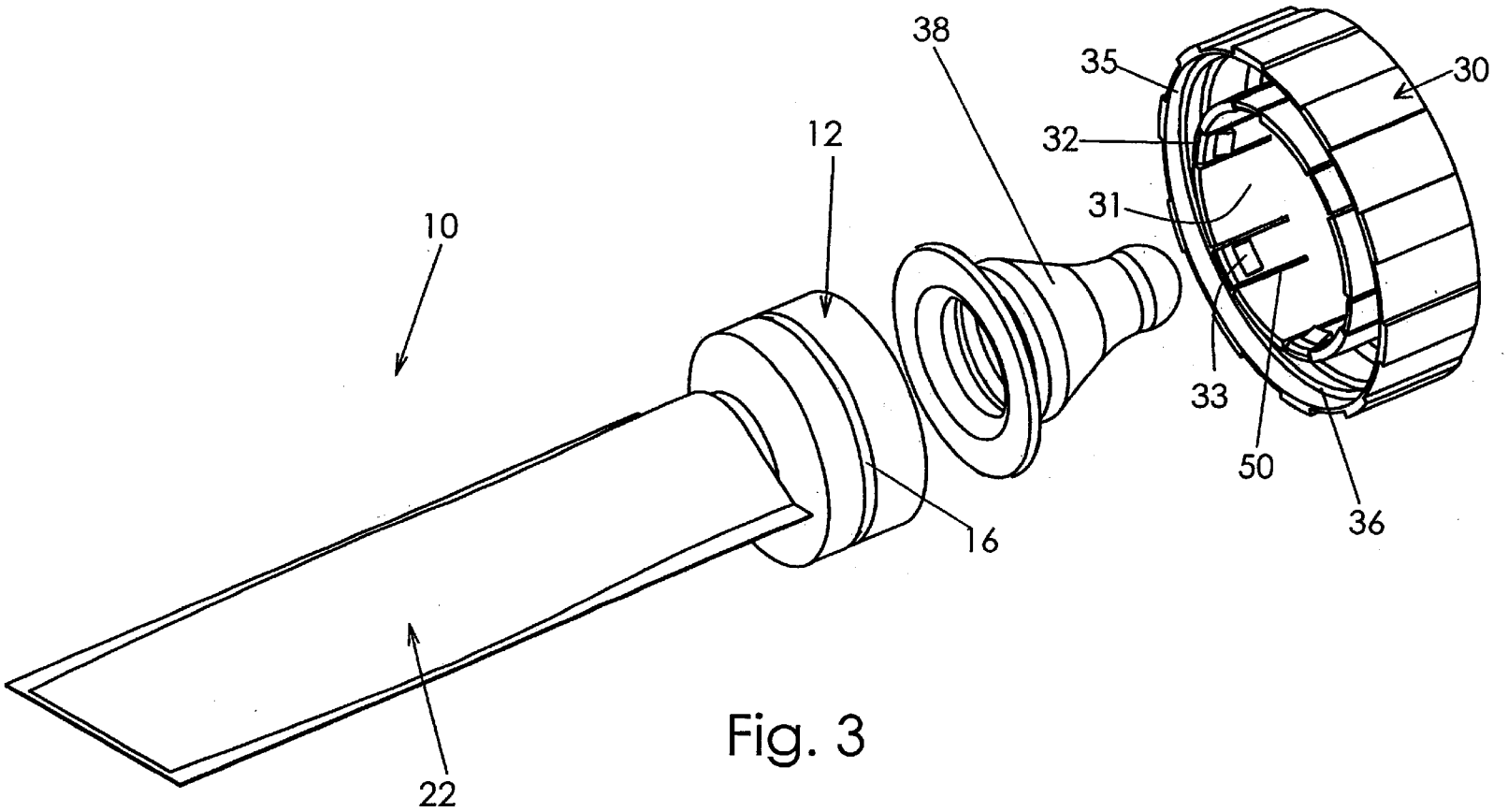
FIG. 3 is an isometric view of an insert to a baby bottle that includes the connector and bag of the present invention together with a cap that includes a nipple.

Referring to FIG. 3, in this embodiment of the present invention, a cap 30 is designed for dispensing formula to an infant. The cap 30 in this embodiment has an inside wall or surface 31 that has a plurality of expansion fingers 32. On each expansion finger 32 is a portion of a circumferential ridge 33 that snaps into the circumferential groove 16 and locks the cap 30 to the connector 12. The baby bottle cap 30 is double walled and between the outer wall 35 and inner wall 31 are threads 36 that thread to a bottle, as will be described herein below. Also in this embodiment is a nipple 38 that seals the top of connector 12.

Figure 5:
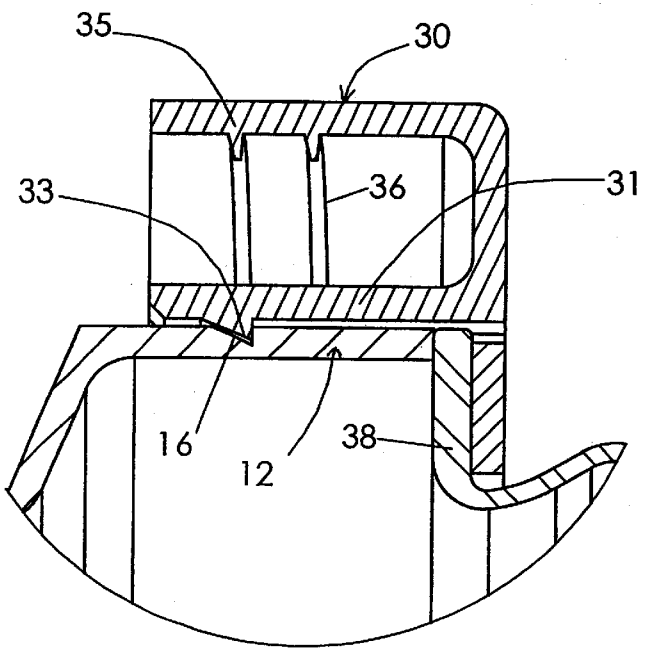
FIG. 5 is an enlarged cross-sectional view of the cap of the baby bottle cap.
Figure 4:
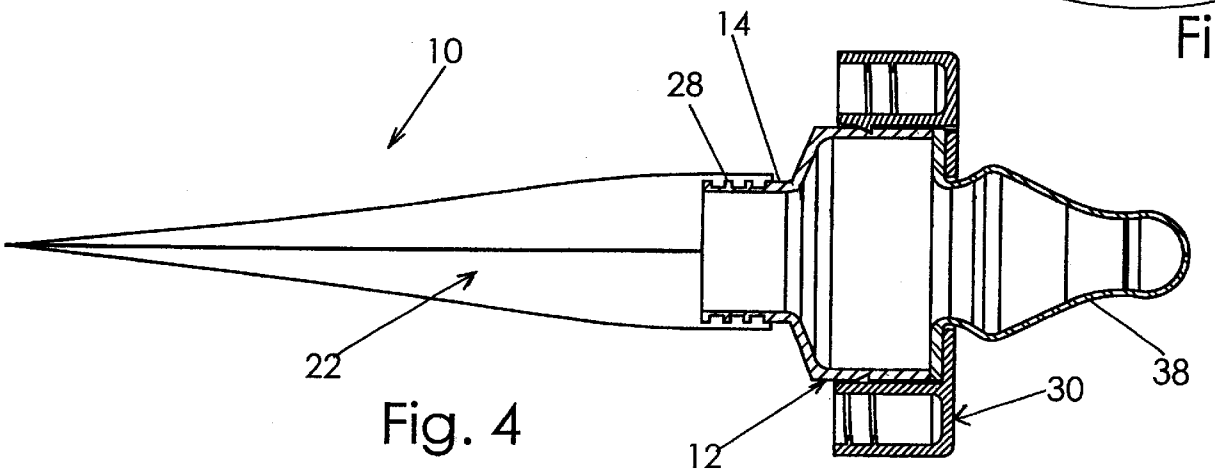
FIG. 4 is a cross-sectional side view of assembled baby bottle insert with the cap that includes a nipple.

The details of the baby bottle cap 30 are shown in FIGS. 4 and 5. In FIG. 4, the dispenser 10 including the connector 12 and bag 22 are shown sealed together. The top of bag 22 has a single seal or plural seals 28 sealing the bag 22 to the neck member 14 of connector 12. The film cover and tab 29 is removed from the top of connector 12 and a nipple 38 is placed on top of connector 12. Cap 30 is double walled and the inside wall fits over the outside surface of connector 12. As seen in the enlarged detail of FIG. 5, fingers with partial circumferential ridges 33 snap into groove 16 of connector 12 and lock the cap 30 to the connector 12. Between the outer wall 35 and inner wall 31 are threads 36 for attaching a bottle.

Figures 6, 7:
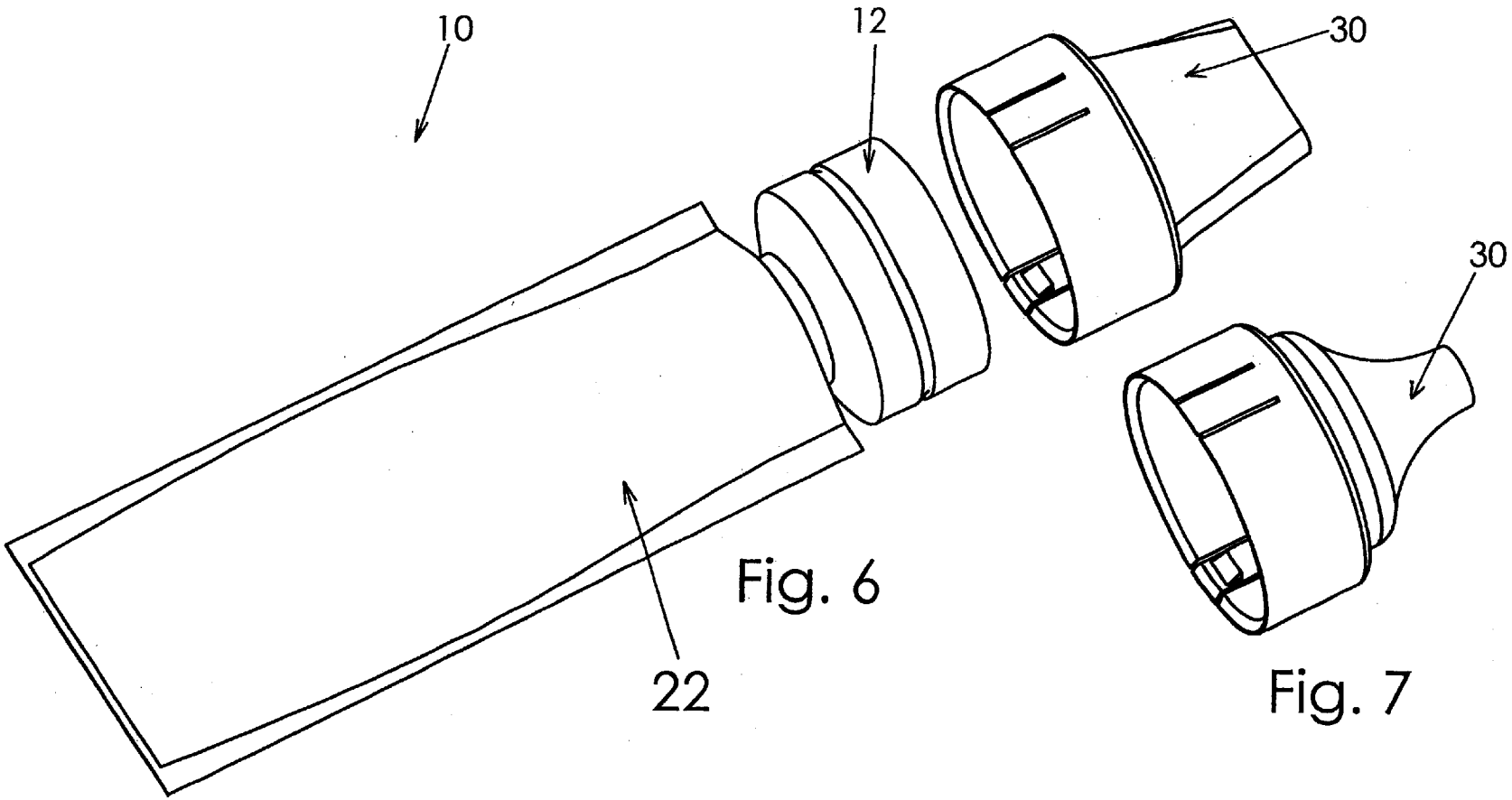
FIG. 6 is a isometric view of the dispenser with a cap of a different design.
FIG. 7 is a isometric view of a cap of a different design.

Referring now to FIGS. 6 and 7, caps 30 in these embodiments have a shaped opening other than a nipple and illustrate that caps may be used having any shaped opening. These caps 30 are single wall and do not need a bottle. For children and adults a bottle is not required. These caps 30 may be injection molded and may have a washer (not shown) inside to seal the cap 30 to the connector 12.

Figure 8:
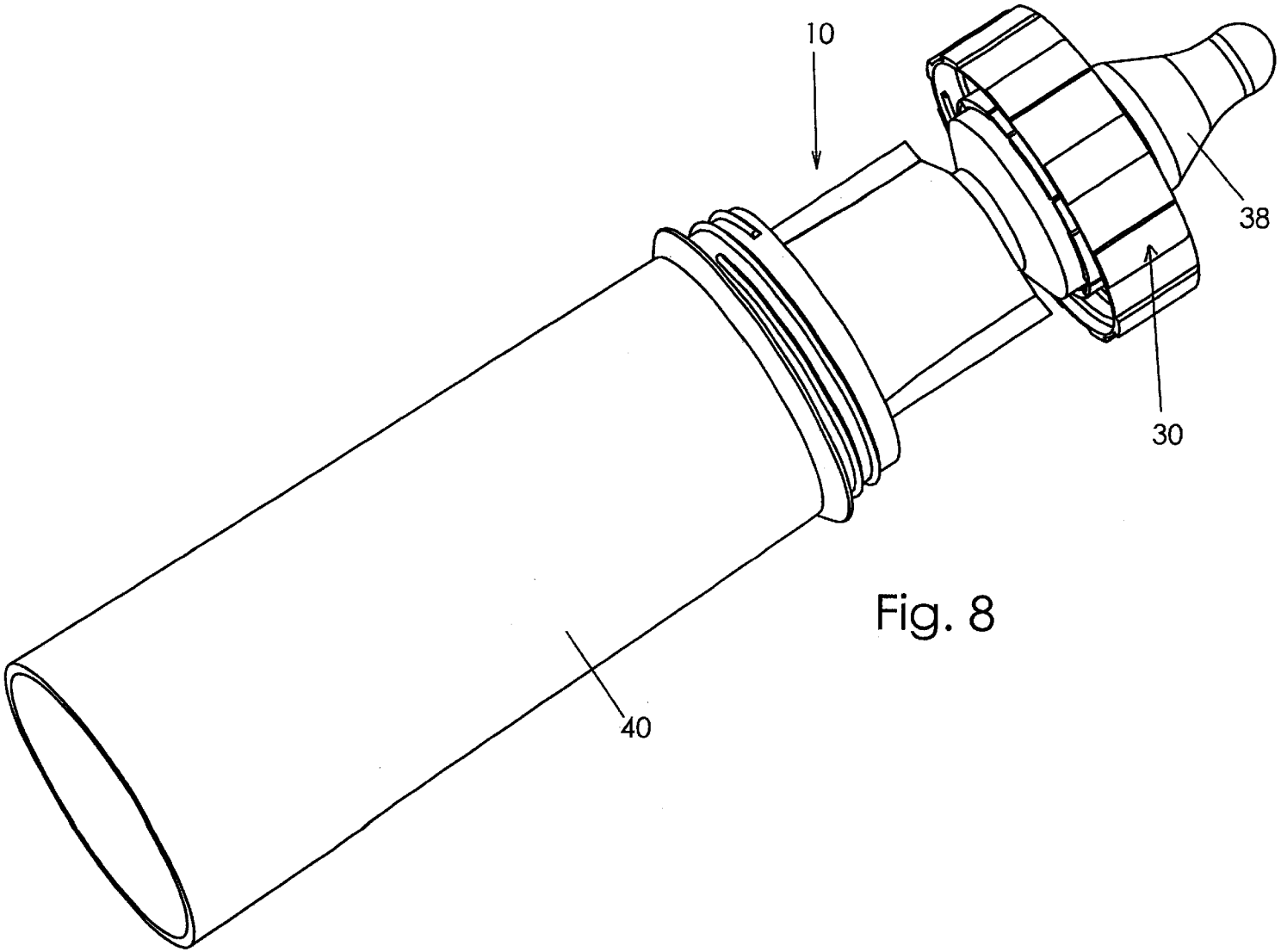
FIG. 8 is an isometric view of the baby bottle design dispenser of the present invention being inserted into a bottle.

In FIG. 8, an embodiment illustrates the complete baby dispenser with a bottle 40.

Referring back to FIG. 5, in preparing a dispensing system for infant formula to places that have bad water and literacy is low, the baby bottle of the present invention is designed to maintain the purity of the solid and liquid from contamination. The cap 30 is designed so that once placed over dispenser 10 that it is difficult to remove the cap 30. It is noted that the number of expansion fingers 32, that portion of the inner wall 31 between parallel slots 50, are greater in the baby bottle embodiment. For economic reasons it may be too costly to make the entire embodiment disposable. Therefore, the cap 30 is designed to be recyclable by having a tool inserted under each finger 32 to lift and move the expansion finger 32 outward sufficiently that each circumferential ridge 33 is removed from groove 16 and cap 30 may be removed from the connector 12. The connector 12, cap 30 and the nipple 38 may be sterilized and reused.

It is noted that the caps 30 illustrated in FIGS. 6 and 7 can be made easily removable from the connector 12 by having less expansion fingers 32 and/or smaller ridges 33. These removed caps 30 may then be used with another dispenser 10.

In all embodiments, once the solid and liquid are mixed, the dispenser 10 is not to be reused and the bag 22 is disposed of after use.

What is claimed is:

1. A dispenser, comprising:

a cylindrical solid connector having an inner surface and an outer surface, said connector having a top and a bottom and said bottom being solid except having a neck shaped internally open member extending there from and having a perimeter smaller than said inner surface; and a plastic bag containing both liquid and solid having an outlet, said outlet sealingly connected to said neck shaped member.

2. A dispenser according to claim 1 which further includes:

a circumferential groove around the outer surface of said cylindrical solid connector.

3. A dispenser according to claim 2 which further includes:

a cover that seals said top of said cylindrical solid connector.

4. A dispenser according to claim 3 wherein said cover is a cylindrical sheet of plastic with a tab.

5. A dispenser according to claim 2 wherein:

said bag has two compartments, one adapted to contain a solid and one adapted to contain a liquid; a sealed seam which is easily rupturable separating said compartments.

6. A dispenser according to claim 5 that further includes:

a dispenser cap having a shaped opening, said inside surface of said cap being cylindrical and having a circumferential ridge that snaps into said circumferential groove of said solid connector to hold said cap to said connector.

7. A dispenser according to claim 5 that further includes:

a dispenser cap having a shaped opening, said inside surface of said cap being cylindrical and having a plurality of expanders that snaps into said circumferential groove of said solid connector to hold said cap to said connector.

8. A dispenser according to claim 6 wherein said cap is a dual cap that has in addition:

a threaded opening in said bottom of said cap for attaching to a bottle; and a nipple that seals the cap of said solid connector and provides the shaped opening.

9. A dispenser, comprising:

a cylindrical solid connector, said connector having a top and a bottom and said bottom being solid except having a neck shaped internally open member extending there from and said connector having a circumferential groove around the outer surface of said cylindrical solid connector;

a cap having a shaped opening, said inside surface of said cap being cylindrical and having a snap member that fits into said circumferential groove of said solid connector to hold said cap to said connector; and a plastic bag containing both liquid and solid having an outlet, said outlet sealingly connected to said neck shaped member.

10. An infant formula dispenser, comprising:

a cylindrical solid connector, said connector having a top and a bottom and said bottom being solid except having a neck shaped internally open member extending there from and said connector having a circumferential groove around the outer surface of said cylindrical solid connector;

a cap having a shaped opening, said inside surface of said cap being cylindrical and having a snap member that fits into said circumferential groove of said solid connector to hold said cap to said connector; and a plastic bag, said bag having two compartments, one adapted to contain a solid formula and one adapted to contain water, a sealed seam which is easily rupturable separating said compartments containing liquid and solid, said bag having an outlet, said outlet sealingly connected to said neck shaped member.

11. An infant formula dispenser according to claim 10 wherein said cap is a dual walled cap that has in addition:

a threaded opening in said bottom of said cap for attaching to a bottle; and a nipple that seals the cap of said solid connector and provides the shaped opening.

* * * * *